US006817662B2

(12) United States Patent
Winter et al.

(10) Patent No.: US 6,817,662 B2
(45) Date of Patent: Nov. 16, 2004

(54) PICNIC TABLE

(75) Inventors: David C. Winter, Layton, UT (US); S. Curtis Nye, Clinton, UT (US)

(73) Assignee: Lifetime Products, inc., Clearfield, UT (US)

( * ) Notice: Subject to any disclaimer, the term of this patent is extended or adjusted under 35 U.S.C. 154(b) by 0 days.

(21) Appl. No.: 10/635,361

(22) Filed: Aug. 5, 2003

(65) Prior Publication Data

US 2004/0108756 A1 Jun. 10, 2004

Related U.S. Application Data

(60) Provisional application No. 60/401,482, filed on Aug. 6, 2002.

(51) Int. Cl.[7] ..... A47B 83/02
(52) U.S. Cl. ..... 297/158.3
(58) Field of Search ..... 297/158.3, 158.5; D6/337

(56) References Cited

U.S. PATENT DOCUMENTS

| | | | | | |
|---|---|---|---|---|---|
| D177,207 | S | * | 3/1956 | Beller | D6/337 |
| D178,535 | S | * | 8/1956 | Oglesby | D6/337 |
| D244,067 | S | * | 4/1977 | Uhl | D6/337 |
| 5,224,753 | A | * | 7/1993 | Fox | 297/158.5 |
| 6,186,590 | B1 | * | 2/2001 | Tseng | 297/158.4 |
| 6,629,723 | B1 | * | 10/2003 | Trubee | 297/158.3 |

* cited by examiner

*Primary Examiner*—Peter R. Brown
(74) *Attorney, Agent, or Firm*—Workman Nydegger

(57) ABSTRACT

A picnic table includes a pair of benches and a central table is generally disposed between the benches. The picnic table may include first and second legs that are used to support the benches and the central table above a support surface such as a floor or the ground. The first and second legs preferably each include a loop portion that supports the benches and a table support portion that supports the central table. Desirably, the loop portion and the table support portion of each leg are generally aligned in the same plane.

18 Claims, 5 Drawing Sheets

PICNIC TABLE

CROSS-REFERENCE TO RELATED APPLICATIONS

This application claims priority to and the benefit of U.S. Provisional Patent Application Ser. No. 60/401,482, entitled Picnic Table, which was filed on Aug. 6, 2002, and is hereby incorporated by reference in its entirety.

BACKGROUND OF THE INVENTION

1. Field the Invention

The present invention generally relates to furniture and, in particular, to picnic tables.

2. Description of Related Art

Picnic tables have been used for many years and conventional picnic tables typically include a center table portion with benches disposed on both sides of the table portion. Conventional picnic tables generally have a rectangular configuration and may be sized to allow four, six or eight persons to sit at one time. Picnic tables are typically located outdoors and are often used as part of an outdoor social gathering that generally includes food or a meal.

It is known to use various types of wood to construct a picnic table. For example, the table top, bench tops and support legs may be constructed from wood. Wooden picnic tables, however, often quickly deteriorate because the picnic tables are generally used outdoors where the tables are exposed to the elements such as sun and rain. Accordingly, wooden picnic tables must be frequently painted or stained in order to protect the wood from damage. It is also known to use metal legs to support a picnic table constructed with a wooden table top and wooden bench tops. The metal legs must be large and strong to support the heavy wooden table top and bench tops.

Disadvantageously, conventional picnic tables constructed from wood are very heavy and require a bulky, heavy-duty frame to support the table top and bench tops. These heavy, wooden picnic tables are often very difficult to transport and move. In addition, known picnic tables with metal legs often require a large and complex frame to support the table top and bench tops. In particular, many known picnic tables require the metal legs to be constructed from large diameter tubing and/or large wall thickness tubing to provide the necessary strength for the legs. Legs constructed from large diameter tubing and/or large wall thickness tubing, however, undesirably increases the weight of the picnic table. The metal legs also often require one or more brackets or support struts to adequately support the table top and bench tops. These brackets and support struts are often placed underneath the table top, which decreases the amount of space and legroom under the table top. Additionally, the brackets or struts undesirably add to the weight and complexity of the picnic table.

Conventional picnic tables may also have a frame that allows the picnic table to be folded into a collapsed position, which allows picnic tables to be more easily shipped and stored because the tables require less space in the collapsed position. In order to allow the picnic table to be collapsed, the frame may be pivotally attached to the table top and the benches. In addition, the collapsible frame may include a number of movable parts and supports to allow the picnic table to be moved into the collapsed position. Disadvantageously, the collapsible frame increases the weight and complexity of the picnic table. The collapsible frame may also require additional time to manufacture and assemble because of the numerous parts that have to be interconnected, and the complex frame may prevent consumers from assembling the picnic table. Thus, these types of picnic tables are generally shipped in an assembled configuration and that undesirably increases shipping and transportation costs.

Known picnic tables often include a number of support struts or braces to securely connect the frame to the table top and the benches. These support struts and braces, however, often interfere with a desired sitting position for an individual seated at the picnic table, and the struts and braces decrease the leg room under the table. That is, the supports and braces often contact an individual's knees or legs, and that decreases the comfort and usefulness of the picnic table. The struts and braces may also limit the number of people that can sit at the picnic table. In particular, because many struts and braces are positioned at various angles relative to the table top and benches, the legroom under the table top is decreased and the risk that a person will strike their knees on the struts or braces is increased.

BRIEF SUMMARY OF THE INVENTION

A need therefore exists for a picnic table that eliminates the above-described disadvantages and problems.

One aspect of the invention is a picnic table with a frame that supports a center table portion and a bench disposed on each side of the table portion. The frame preferably includes a first leg that is disposed near one end of the table portion and benches, and a second leg that is disposed near the other end of the table portion and benches. The first and second legs may each include a loop portion that supports the benches and contacts a support surface such as the ground. The first and second legs may also each include a support portion that supports the table top. The support portion preferably includes two generally upright or vertical supports that are connected to the loop portion and the lower portion of the table top.

Another aspect is a frame for a picnic table that includes a first leg and a second leg. The first and second legs are preferably positioned generally perpendicular to an elongated axis of the table top and the benches. In addition, the components of the first leg are preferably generally aligned in the same plane, and the components of the second leg are also preferably generally aligned in the same plane. Further, the first and second legs are preferably positioned generally parallel to each other. Advantageously, because the components of the first and second legs are generally aligned in the same plane and the legs are positioned parallel to each other, the picnic table has a large amount of leg room. The picnic table desirably does not include any braces or support struts located under the table top in order to maximize the space and legroom under the table top.

Yet another aspect is a frame for a picnic table that is sturdy and strong. In particular, the frame may be sized and configured to allow the picnic table to support four, six or eight adults, for example. The frame is preferably constructed from thin-walled metal tubing. The thin-walled metal tubing allows a strong and lightweight picnic table to be constructed. The thin-walled metal tubing desirably has a small diameter to reduce the weight of the picnic table. Significantly, the small diameter, thin-walled metal tubing requires a very small amount of space under the table top, which maximizes the legroom under the table top.

The picnic table may be very lightweight because the table top and bench tops are desirably constructed from blow-molded plastic and the frame is desirably constructed from small diameter, thin-walled metal tubing. Advantageously, the lightweight picnic table may reduce shipping costs. In particular, the lightweight picnic table may be shipped to a retailer or consumer at less cost than a conventional picnic table because of its lightweight. In addition, the picnic table may be more easily assembled and disassembled because of its lightweight. Further, the lightweight picnic table is easy to transport and move because of its reduced weight. This may allow the consumer to easily move the picnic table from one location to another location.

Still another aspect is a picnic table with a relatively straightforward design, which allows the picnic table to be easily assembled and disassembled by the manufacturer or the consumer. Desirably, the picnic table can be assembled and disassembled using commonly available tools such as screwdrivers and wrenches. Significantly, this allows the picnic table to be easily assembled by either the manufacturer or the consumer.

Yet another aspect is a picnic table with a table top and bench tops that are constructed from blow-molded plastic. The blow-molded plastic table top and bench tops are preferably high-strength, lightweight and generally weather resistant. The blow-molded table top and bench tops may include two opposing surfaces that are separated by a generally constant distance. The upper surfaces may be generally planar and the lower surfaces may include a plurality of depressions that are sized and configured to increase the strength of the table top and bench tops. The depressions may cover only a portion of the lower surface, substantially all of the lower surface, or the entire lower surface of the table top and/or bench tops.

Another aspect is a picnic table with a first bench, a second bench, a central table, a first leg, and a second leg. The first leg may include a loop portion that is connected to the first bench and the second bench, and a table support portion that is connected to the central table. The second leg may include a loop portion that is connected to the first bench and the second bench, and a table support portion that is connected to the central table. Preferably, the loop portion and the table support portion of the first leg are generally aligned in a first plane, and the loop portion and the table support portion of the second leg are generally aligned in a second plane. The first plane is preferably generally parallel to and spaced apart from the second plane. In addition, the loop portion of the first leg is preferably generally continuous and has a generally rectangular configuration, and the loop portion of the second leg is preferably generally continuous and has a generally rectangular configuration. Further, the table support portion of the first leg may include two generally upright members that are connected to the loop portion of the first leg and the central table, and the table support portion of the second leg may include two generally upright members that are connected to the loop portion of the second leg and the central table.

Still another aspect is a picnic table including a center table with a first side and a second side, a first bench disposed near the first side of the center table, a second bench disposed near the second side of the center table, and a frame supporting the center table, the first bench and the second bench above a support surface. The frame preferably includes a first leg with a loop portion that supports a first end of the first bench and a first end of the second bench above the support surface. The first leg preferably also includes a table support connected to the loop portion and the center table to support the center table above the support surface. In addition, the frame preferably includes a second leg with a loop portion that supports a second end of the first bench and a second end of the second bench above the support surface. The second leg preferably also includes a table support connected to the loop portion and the center table to support the center table above the support surface.

Advantageously, the table support of the first leg may include a pair of generally parallel support members and the table support of the second leg may include a pair of generally parallel support members. In addition, the picnic table may include a cross bar attached to the pair of generally parallel support members of the table support of the first leg and a cross bar attached to the pair of generally parallel support members of the table, support of the second leg. The picnic table may further include a pair of side rails connected to the center table, and the side rails may be connected to the cross bar of the table support of the first leg and the cross bar of the table support of the second leg. Further, the loop portion of the first leg may be generally continuous and have a generally rectangular configuration, and the loop portion of the second leg may be generally continuous and have a generally rectangular configuration. Finally, the loop portion of the first leg may include an elongated upper member that is generally parallel to an elongated lower member, and the loop portion of the second leg may include an elongated upper member that is generally parallel to an elongated lower member.

A further aspect is a picnic table including a first support with a loop portion and a table support portion that are generally aligned in the same plane, a second support with a loop portion and a table support portion that are generally aligned in the same plane, a first bench connected to the loop portion of the first support and the loop portion of the second support, a second bench connected to the loop portion of the first support and the loop portion of the second support; and a table portion connected to the table support portion of the first support and the table support portion of the second support. Preferably, the loop portion of the first support and the loop portion of the second support have a generally rectangular configuration and are generally continuous. Additionally, the loop portion of the first support is preferably constructed from a single support tube and the loop portion of the second support is preferably constructed from a single support tube. Finally, the table support portion of the first support may include a pair of generally upright supports that are connected to the loop portion of the first support, and the table support portion of the second support may include a pair of generally upright supports that are connected to the loop portion of the second support.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is directed towards a picnic table. The principles of the present invention, however, are not limited to a picnic table. It will be understood that, in light of the present disclosure, the picnic table disclosed herein can be successfully used in connection with other types of furniture and equipment.

Additionally, to assist in the description of the picnic table, words such as top, bottom, front, rear, right and left are used to describe the accompanying figures. It will be appreciated, however, that the picnic table can be located in a variety of desired positions. A detailed description of the picnic table now follows.

Figure 1:
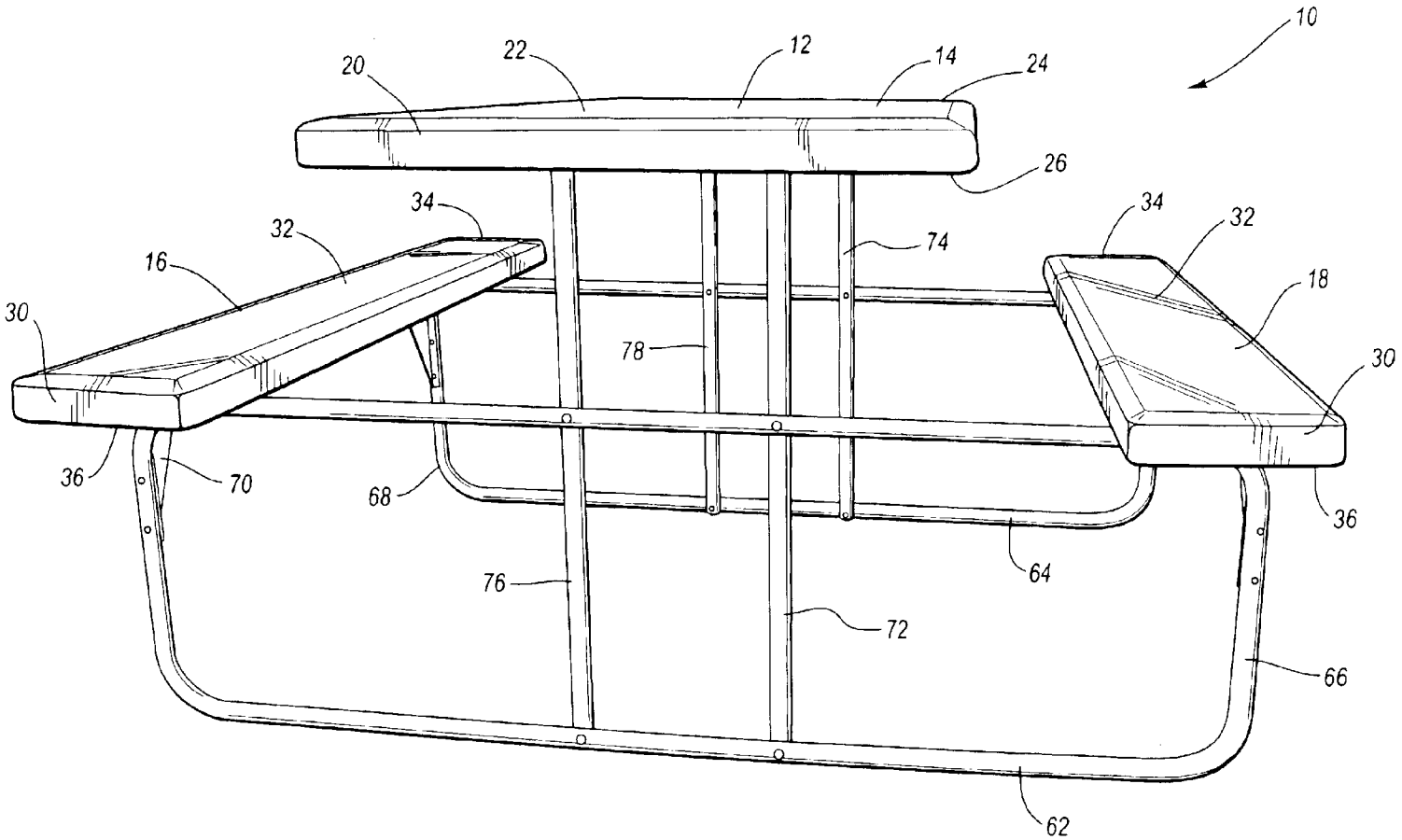
FIG. 1 is a perspective view of a picnic table in accordance with a preferred embodiment of the present invention.
Figure 2:
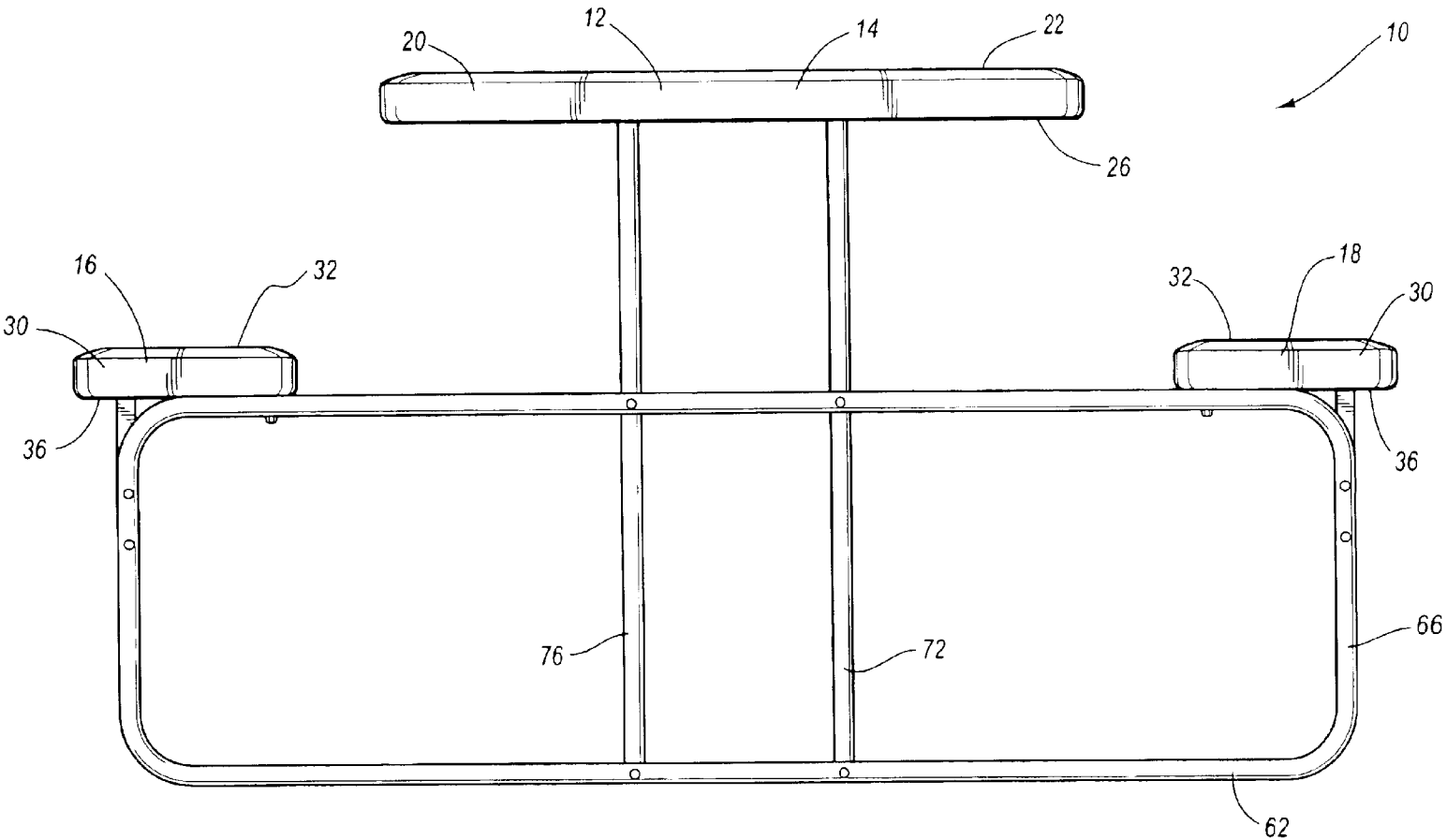
FIG. 2 is a side view of the picnic table shown in FIG. 1.
Figure 3:
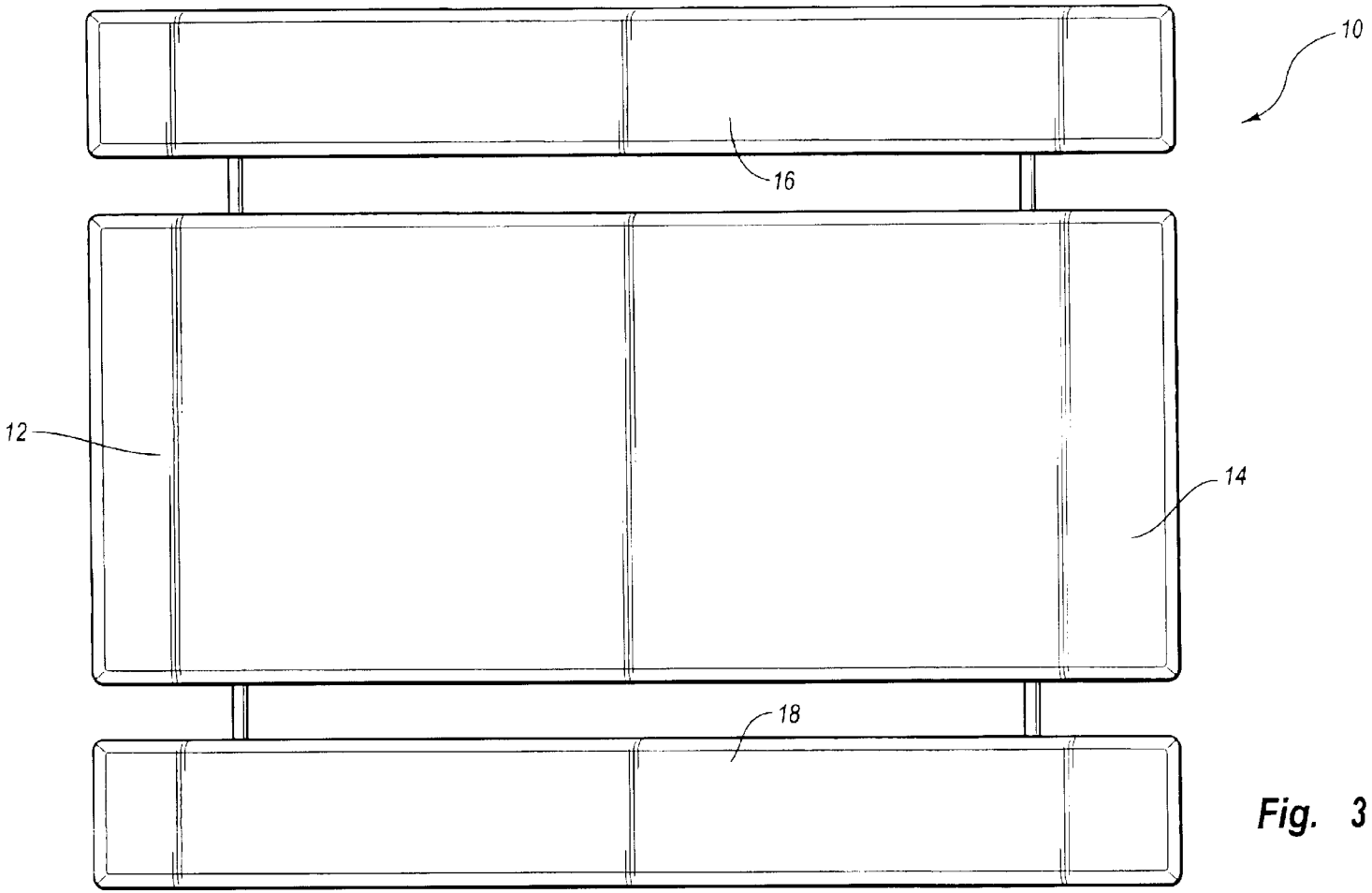
FIG. 3 is a top view of the picnic table shown in FIG. 1.

As seen in FIG. 1, the picnic table 10 includes a center table portion 12 with a table top 14 and a pair of benches 16, 18. The table top 14 includes a first end 20, an upper portion 22, a second end 24, and a lower portion 26. The table top 14 preferably includes an interior chamber 28 that is disposed between the upper portion 22 and the lower portion 26, and the chamber is preferably generally hollow. It will be appreciated that the generally hollow chamber 28 may include one or more structures disposed within the chamber such that it is partially hollow or the chamber may be completely hollow.

The benches 16, 18 include a first end 30, an upper portion 32, a second end 34, and a lower portion 36. The benches 16, 18 also preferably include an interior chamber 38 that is disposed between the upper portion 32 and the lower portion 36, and the chamber is preferably generally hollow. It will be appreciated that the generally hollow chamber 38 may include one or more structures disposed within the chamber such that it is generally hollow or the chamber may be completely hollow.

The table top 14 and benches 16, 18 are preferably constructed from plastic, but any materials with suitable characteristics could also be used. The table top 14 and benches 16, 18 are also preferably constructed using a blow-molding process. Advantageously, the blow-molded table top 14 and benches 16, 18 are lightweight, strong and weather resistant. It will be appreciated, however, that the table top 14 and/or benches 16, 18 could also be constructed by other suitable methods and processes such as injection molding, vacuum-forming, and the like.

The table top 14 and benches 16, 18 are preferably generally rectangular in configuration with a length that is larger than the width. The benches 16, 18 are preferably disposed near the sides of the table top 14 and the benches are sized and configured to allow one or more individuals to sit on the benches and use the center table portion 12 for purposes such as eating. Desirably, the picnic table 10 is sized and configured to allow four, six or eight people to sit at the picnic table at one time. It will be appreciated, however, that the picnic table 10 could be larger, smaller, or have any desired size, and the picnic table could have any suitable configuration or arrangement such as square, circular, oblong and the like depending, for example, upon the intended use and/or design of the picnic table. Additionally, it will be appreciated that the benches 16, 18 may be disposed in any desired location relative to the table top 14 and the benches could have any desired size and configuration depending, for example, upon the size and configuration of the table top.

The upper portions 22, 32 of the table top 14 and benches 16, 18 are preferably generally planar surfaces and these surfaces may be smooth or textured, if desired. The table top 14 and benches 16, 18 may also include sidewalls that are preferably generally perpendicular to the upper portions 22, 32 and lower portions 26, 36 of the table top and benches. The transitions between the sidewalls and the upper portions 22, 32 and lower portions 26, 36 of the table top 14 and benches 16, 18 are preferably rounded or beveled for comfort, but the transitions could have any desired shapes and configurations. It will also be appreciated that the sidewalls do not have to be perpendicular to either the upper portions 22, 32 or the lower portions 26, 36 of the table top 14 and benches 16, 18, and the sidewalls could have any desired shapes and configurations.

Figure 4:
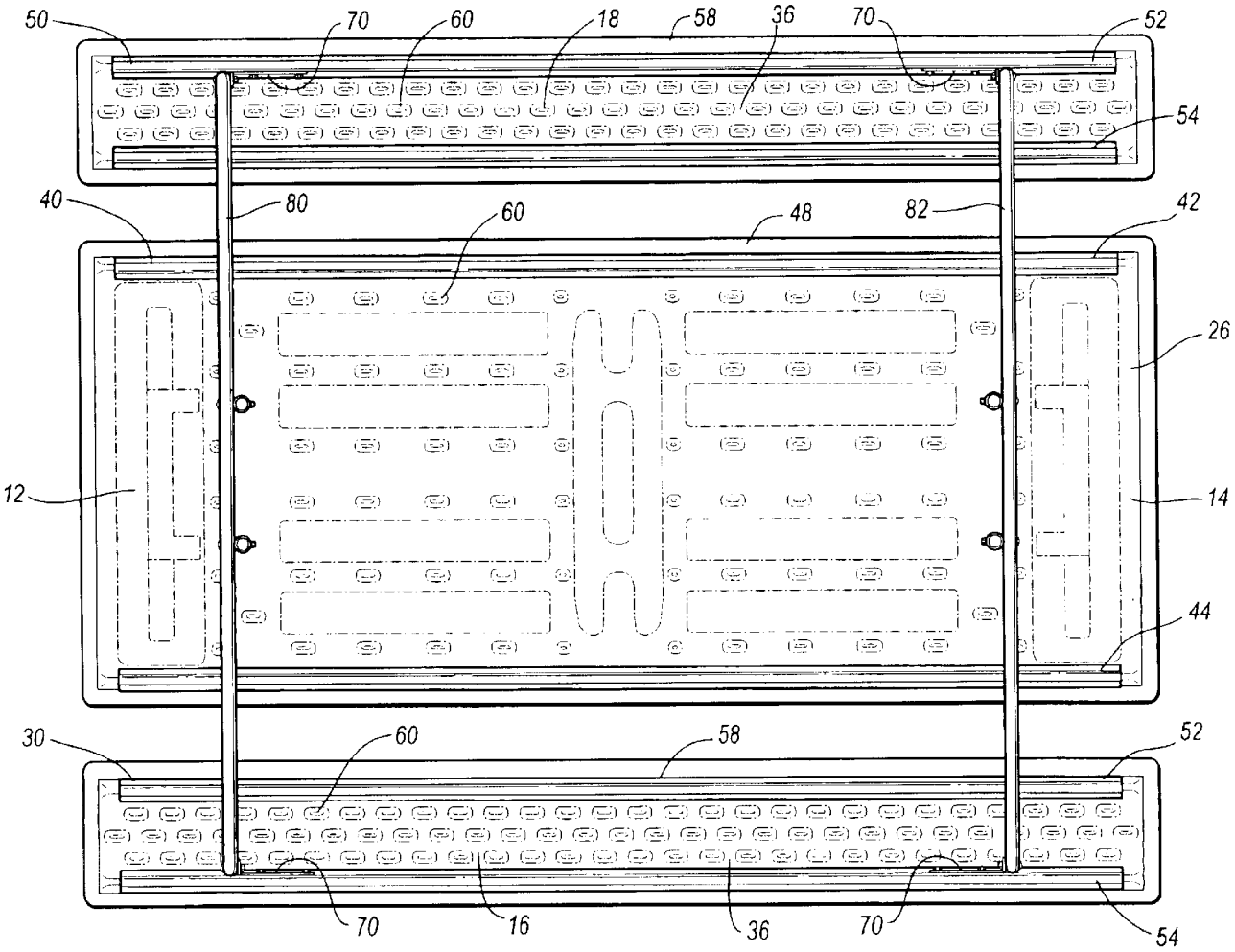
FIG. 4 is a bottom view of the picnic table shown in FIG. 1.
Figure 5:
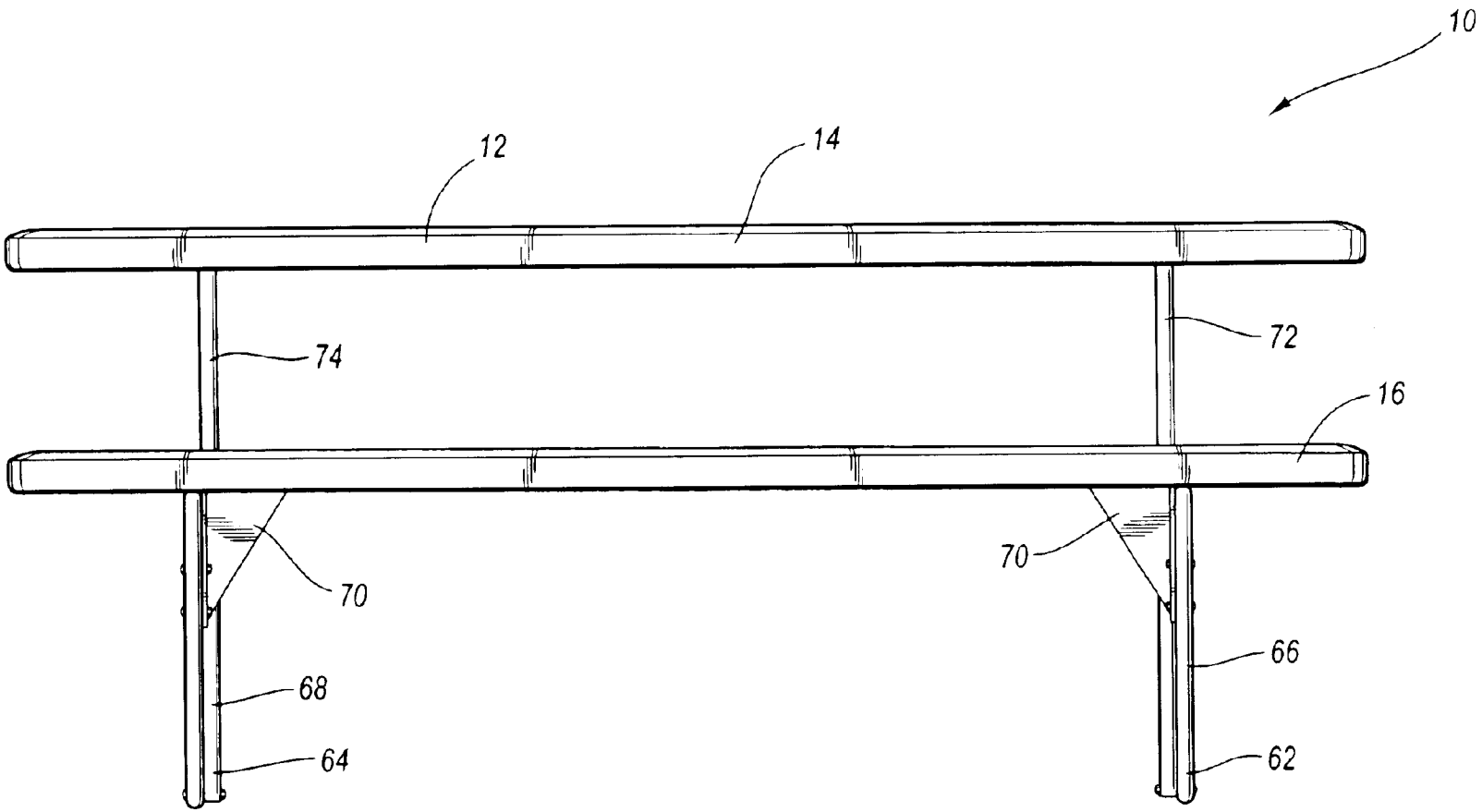
FIG. 5 is a front view of the picnic table shown in FIG. 1.

As best seen in FIG. 4, the table top 14 includes a frame 40 with a first side rail 42 and an opposing second side rail 44. Preferably, the first side rail 42 is disposed substantially parallel to the second side rail 44, and the side rails preferably extend generally along the length of the table top 14. The length and configuration of the side rails 42, 44 may depend, for example, upon the length and configuration of the table top 14. In addition, the side rails 42, 44 may extend only a portion of the length of the table top 14. Advantageously, the side rails 42, 44 may help prevent bowing, twisting, or deformation of table top 14, but it will be appreciated that the table top does not require the use of a frame or side rails.

The frame 40 may be attached to a downwardly extending lip 48 located at or near the outer periphery of the table top 14. For example, the frame 40 may be attached to an inner surface of the downwardly extending lip 48 by one or more fasteners. It will be understood that other suitable means or methods for attaching the frame 40 to the table top 14 may be employed, including, but not limited to, rivets, screws, bolts, glues, epoxies, or other bonding materials. The height of the inner surface of the lip 48 is preferably generally equal to or greater than the height of the frame 40 so that the frame is generally hidden from view when the picnic table 10 is observed from a plane generally aligned with the upper surface 22 of the table top 14. Advantageously, because the frame 40 may be completely or generally hidden from view, the frame does not have to be finished and it may contain visible imperfections or flaws. In addition, because the frame 40 may be completely or generally hidden from view by the lip 48, a more aesthetically pleasing picnic table 10 may be created. It will be appreciated, however, that the lip 48 does not have to hide all or a portion of the frame 40.

The connection of the frame 40 to the table top 14 may also be hidden from view by the lip 48. For example, one or more fasteners, such as bolts or screws, may be used to connect the frame 40 to the table top 14. Because the fasteners desirably extend only through the frame 40 and the inner surface of the lip 48 and not the outer surface of the lip, the fasteners are preferably not visible when the picnic table 10 is viewed from a plane that is generally aligned with or above the table top 14.

Advantageously, because the frame 40 can be attached to the inner surface of the lip 48, no screws or bolts have to be attached to the bottom surface 16 of the table top 14. Because no holes have to be drilled or formed in the bottom surface 16 of the table top 14, no stress concentrations or failure points are formed in the table top 14. Thus, the strength and structural integrity of the table top 14 is not compromised by creating holes in the table top. In addition, because the frame 40 is preferably not bonded to the bottom surface of table top 14, the table top is not weakened or damaged by adhesive. Thus, strength and integrity of the table top 14 may be retained because the frame 40 is not screwed, bolted or bonded directly to bottom surface 16 of the table top. Further, the attachment of the frame 40 to the lip 48 may reduce the stresses imposed on the bottom surface 16 of the table top 14, which may reduce the likelihood of deformation or damage to the table top. It will be appreciated, however, that the frame 40 could be attached to any desired portion of the table top 14.

As shown in the accompanying figures, the lip 48 is disposed about the periphery of the table top 14 and it may form at least part of an outer edge or boundary of table top. It will be appreciated that the lip 48 does not have to create the outer edge or boundary of the table top 14 and the lip can extend around all or only a portion of table top 14. The lip 48 is preferably integrally formed with the table top 14 during a blow-molded process to create a unitary, one-piece structure. It will be understood that the table top 14 and the lip 48 may also be formed from two or more pieces that are subsequently attached by any suitable mechanism or method such as fasteners, adhesives, and like.

The side rails 42, 44 of the frame 40 preferably have a generally S-shaped cross section with a main body portion and two outwardly extending flanges. One flange is preferably positioned proximate a lower portion of lip 48 and the other flange is preferably positioned proximate the lower portion 26 of table top 14. It will be appreciated that the flanges may either contact or be spaced apart from the lower portion of the lip 48 or the lower portion 26 of the table top 14, respectively, as desired. It will also be appreciated that the flanges or other portions of the side rails 42, 44 may be positioned within grooves, slots or other openings to facilitate attachment of the frame 40 to the table top 14. This may allow, for example, the side rails 42, 44 of the frame 40 to be connected to the table top 14 by a friction, interference or snap fit connection. It will be understood that the frame 40, side rails 42, 44, and lip 48 may have other suitable configurations and arrangements depending, for example, upon the intended size and use of the picnic table 10. In particular, the frame 40, side rails 42, 44, and lip 48 may have other configurations and arrangements if the table top 14 is in the form of a circle, polygon, square, triangle, or any other suitable geometrical configuration.

The benches 16, 18 preferably each include a frame 50 with a first side rail 52 and an opposing second side rail 54. Preferably, the first side rail 52 is disposed substantially parallel to the second side rail 54, and the side rails preferably extend generally along the length of the benches 16, 18. The length and configuration of the side rails 52, 54 may depend, for example, upon the length and configuration of the benches 16, 18. In addition, the side rails 52, 54 may extend only a portion of the length of the benches 16, 18. Advantageously, the side rails 52, 54 may help prevent bowing, twisting, or deformation of the benches 16, 18, but it will be appreciated that benches do not require the use of a frame or side rails.

The benches 16, 18 may include a downwardly extending lip 58 that is located at or near the outer periphery of the benches and the frame 50 may be attached to the lip. For example, the frame 50 may be attached to an inner surface of the downwardly extending lip 58 by one or more fasteners. It will be understood that other suitable means or methods for attaching the frame 50 to the benches 16, 18 may be employed, including, but not limited to, rivets, screws, bolts, glues, epoxies, or other bonding materials. The height of the inner surface of the lip 58 is preferably generally equal to or greater than the height of the frame 50 so that the frame is generally hidden from view when the picnic table 10 is observed from a plane generally aligned with the upper portion 32 of the benches 16, 18. Advantageously, because the frame 50 may be completely or generally hidden from view, the frame does not have to be finished and it may contain visible imperfections or flaws. In addition, because the frame 50 may be completely or generally hidden from view by the lip 58, a more aesthetically pleasing picnic table 10 may be created. It will be appreciated, however, that the lip 58 does not have to hide all or a portion of the frame 50.

The connection of the frame 50 to the benches 16, 18 may also be hidden from view by the lip 58. For example, one or more fasteners, such as bolts or screws, may be used to connect the frame 50 to the benches 16, 18. Because the fasteners desirably extend only through the frame 50 and the inner surface of the lip 58 and not the outer surface of the lip, the fasteners are preferably not visible when the picnic table 10 is viewed from a plane that is generally aligned with or above the benches 16, 18.

Advantageously, because the frame 50 can be attached to the inner surface of the lip 58, no screws or bolts have to be attached to the lower portion of the benches 16, 18. Because no holes have to be drilled or formed in the lower portion of the benches 16, 18, no stress concentrations or failure points are formed in the benches. Thus, the strength and structural integrity of the benches 16, 18 is not compromised by creating holes in the benches. In addition, because the frame 50 is preferably not bonded to the lower portion of the benches 16, 18, the benches are not weakened or damaged by adhesive. Thus, strength and integrity of the benches 16, 18 may be maintained because the frame 50 is not screwed, bolted or bonded directly to bottom surface 16 of the table top. Further, the attachment of the frame 50 to the lip 58 may reduce the stresses imposed on the lower portion of the benches 16, 18, which may reduce the likelihood of deformation or damage to the benches. It will be appreciated, however, that the frame 50 could be attached to any desired portion of the benches 16, 18.

As shown in the accompanying figures, the lip 58 is disposed about the periphery of the benches 16, 18 and it may form at least part of an outer edge or boundary of benches. It will be appreciated that the lip 58 does not have to create the outer edge or boundary of the benches 16, 18 and the lip can extend around all or only a portion of benches. The lip 58 is preferably integrally formed with the benches 16, 18 during a blow-molded process to create a unitary, one-piece structure. It will be understood that the benches 16, 18 and the lip 58 may also be formed from two or more pieces that are subsequently attached by any suitable mechanism or method such as fasteners, adhesives, and like.

The side rails 52, 54 of the frame 50 preferably have a generally S-shaped cross section with a main body portion and two outwardly extending flanges. One flange is preferably positioned proximate a lower portion of lip 58 and the other flange is preferably positioned proximate the lower portion of the benches 16, 18. It will be appreciated that the flanges may either contact or be spaced apart from the lower portion of the lip 48 or the lower portion of the benches 16, 18, respectively, as desired. It will also be appreciated that the flanges or other portions of the side rails 52, 54 may be positioned within grooves, slots or other openings to facilitate attachment of the frame 50 to the benches 16, 18. This may allow, for example, the side rails 52, 54 of the frame 50 to be connected to the benches 16, 18 by a friction, interference or snap fit connection. It will be understood that the frame 50, side rails 52, 54, and lip 58 may have other suitable configurations and arrangements depending, for example, upon the intended size and use of the picnic table 10. In particular, the frame 50, side rails 52, 54, and lip 58 may have other configurations and arrangements if the benches 16, 18 are in the form of a circle, polygon, square, triangle, or any other suitable geometrical configuration.

As best seen in FIG. 4, the bottom portion 26 of table top 14 and the bottom portion of the benches 16, 18 preferably include a plurality of depressions 60 that are sized and configured to increase the strength and structural integrity of the table top and benches, respectively. The depressions 60 are preferably formed in the lower portion of the table top 14 and benches 16, 18, and the depressions extend towards the upper portion of the table top and benches. The ends of the depressions 60 may contact or engage the upper portion of the table top 14 or benches 16, 18, or the ends of the depressions may be spaced from the upper portion of the table top or benches. As shown in the accompanying figures, a number of depressions 60 are formed in the lower portion of the table top 14 and benches 16, 18, but it will be appreciated that any suitable number of depressions may be formed in the table top or benches. Additionally, while the depressions 60 are shown and described as being located in the lower portion of the table top 14 and benches 16, 18, the depressions could be formed in any desired portion of the table top or benches.

The depressions 60 are preferably arranged into a predetermined pattern or array in order to increase the strength and structural integrity of the table top 14 and benches 16, 18. In particular, the depressions 60 are preferably spaced closely together which allows a table top 14 and benches 16, 18 with increased strength to be constructed. Preferred embodiments of suitable depressions and various arrangements of the depressions are disclosed in Assignee's copending U.S. patent application Ser. No. 10/490,000, entitled High Strength, Light Weight Blow Molded Plastic Structures, which is incorporated by reference in its entirety.

Advantageously, the smaller distance between the depressions 60 may increase the structural integrity and strength of the table top 14 and benches 16, 18, which allows the thickness of the outer wall of the table top and benches to be decreased. Accordingly, less plastic material may be used to construct the table top 14 and benches 16, 18 because of the reduced outer wall thickness. Because less plastic is required to construct the table top 14 and benches 16, 18, that may reduce the weight of the picnic table 10.

The picnic table 10 also includes a first leg or support portion 62 and a second leg or support portion 64 that are sized and configured to support the center table portion 12 and the benches 16, 18 about a support surface such as the ground or floor. The first and second support portions 62, 64 are preferably disposed proximate or at the first and second ends 22, 24 of table top 14 and benches 16, 18. It will be understood that the first and second support portions 62, 64 could be disposed in any appropriate arrangement depending, for example, upon the intended use and design of the picnic table 10.

The first and second support portions 62, 64 each include a loop portion 66, 68, respectively, that provides structural support for the other components of the table. The loop portions 66, 68 preferably have a generally rectangular configuration and may be constructed as a continuous loop. The loop portions 66, 68 may also be constructed as an integral, one-piece component or the loop portions may be constructed from multiple pieces that are connected into the desired shape and configuration. As shown in the accompanying figures, the loop portions 66, 68 desirably support the benches 16 18. In particular, the loop portions 66, 68 may be connected to the frame 50 of the benches. Braces 70 may be used to facilitate attachment of the loop portions 66, 68 to the benches 16, 18, but the braces are not required. Advantageously, with the braces 70 in the illustrated positions, the braces do not interfere with an individual seated on the benches 16, 18. That is, because the braces 70 are located beneath the benches 16, 18, the braces do not hit an individual's knees when the individual is seated.

The first and second support portions 62, 64 each include a table support 72, 74 that provides support for the center table portion 12 of the picnic table 10. The table supports 72, 74 desirably each include a pair of generally upwardly extending members 76, 78 and a cross bar 80, 82, respectively. The generally upwardly extending members 76, 78 are preferably connected to the loop portions 66, 68 of the first and second support portions 62, 64, and the cross bars 80 82 are preferably connected to the frame 40 of the center table portion 12.

Desirably, the first and second supports 62, 64 are connected to the center table portion 12 and the benches 16, 18 by fasteners such as screws or bolts. Advantageously, this allows the picnic table 10 to be easily assembled and disassembled. This may reduce manufacturing costs because the picnic table 10 can be quickly assembled with a minimum of labor. This also allows the picnic table 10 to be shipped in an unassembled configuration and the consumer can assemble the picnic table.

Each of the first and second supports 62, 64 are desirably aligned in generally the same plane and the supports are preferably connected perpendicular to the center table portion 12 and benches 16, 18. In addition, preferably no braces, struts or other similar structures are located underneath the center table portion 12. Advantageously, this maximizes the space under the center table portion 12 and the legroom for people sitting at the picnic table 10. Thus, the first and second supports 62, 64 preferably support the center table portion 12 and the benches 16, 18 in a manner that eliminates braces or struts that interfere with an individual seated upon the benches of the picnic table.

The configuration of the first and second supports 62, 64, including the loop portions 66, 68 and table supports 72, 74, preferably maximizes the support for the center table portion 12 and the benches 16, 18, while minimizing the weight of the picnic table 10. In particular, the first and second support 62, 64 are preferably constructed from tubing that is constructed from material with the appropriate characteristics, such as metal, steel and the like. The tubing preferably has a relatively thin outer wall and small diameter. Advantageously, this may reduce the weight of the first and second supports 62, 64. In addition, this may reduce the cost of the picnic table 10. Significantly, the lightweight first and second supports 62, 64 may allow the overall weight of the picnic table 10 to be reduced, which may decrease shipping costs and allow the picnic table to be more easily moved into a desired location. One skilled in the art will understand that the first and second supports 62, 64, including the loop portions 66, 68 and table supports 72, 74, may also be constructed from other materials with the appropriate characteristics, and the first and second supports may be formed or arranged into other suitable configurations and arrangements. One skilled in the art will also understand that the picnic table 10 and its various components may have other suitable arrangements and configurations depending, for example, upon the intended use of the picnic table.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A picnic table comprising:

a first bench;

a second bench;

a central table;

a first leg including an at least substantially closed loop portion with a generally rectangular configuration and a table support portion, the loop portion being constructed from an integral, one-piece component, the first bench and the second bench being connected to the loop portion of the first leg, the table support portion being disposed proximate a center portion of the loop portion and being disposed between the first bench and the second bench, the table support portion being connected to a lower portion of the loop portion and an upper portion of the loop portion, the central table being connected to the table support portion; and a second leg including an at least substantially closed loop portion with a generally rectangular configuration and a table support portion, the loop portion being constructed from an integral, one-piece component, the first bench and the second bench being connected to the loop portion of the second leg, the central table being connected to the table support portion, the table support portion being disposed proximate a center of the loop portion and being disposed between the first bench and the second bench, the table support portion being connected to a lower portion of the loop portion and an upper portion of the loop portion.

2. The picnic table as in claim 1, wherein the loop portion and the table support portion of the first leg are generally aligned in a first plane; and wherein the loop portion and the table support portion of the second leg are generally aligned in a second plane.

3. The picnic table as in claim 2, wherein the first plane is generally parallel to and spaced apart from the second plane.

4. The picnic table as in claim 1, wherein the loop portion of the first leg is generally continuous; and wherein the loop portion of the second leg is generally continuous.

5. The picnic table as in claim 1, wherein the table support portion of the first leg includes two generally upright members that are connected to the loop portion of the first leg and the central table; and wherein the table support portion of the second leg includes two generally upright members that are connected to the loop portion of the second leg and the central table.

6. The picnic table as in claim 1, further comprising a frame connected to the central table, the table support portion of the first leg and the table support portion of the second leg being connected to the frame.

7. The picnic table as in claim 1, wherein the loop portion of the first leg includes an elongated upper member that is generally parallel to an elongated lower member; and wherein the loop portion of the second leg includes an elongated upper member that is generally parallel to an elongated lower member.

8. A picnic table comprising:

a center table including a first side and a second side;

a first bench disposed near the first side of the center table;

a second bench disposed near the second side of the center table; and a support assembly supporting the center table, the first bench and the second bench above a support surface, the support assembly comprising:

a first leg including an at least substantially closed loop portion with a generally rectangular configuration, the loop portion being constructed from an integral, one-piece component, the loop portion supporting a first end of the first bench and a first end of the second bench above the support surface, the first leg including a table support being disposed proximate a center portion of the loop portion and between the first bench and the second bench, the table support portion being connected to a lower portion of the loop portion and an upper portion of the loop portion, the table support supporting the center table above the support surface; and a second leg including an at least substantially closed loop portion with a generally rectangular configuration, the loop portion being constructed from an integral, one-piece component, the loop portion supporting a second end of the first bench and a second end of the second bench above the support surface, the first leg including a table support being disposed proximate a center portion of the loop portion and between the first bench and the second bench, the table support portion being connected to a lower portion of the loop portion and an upper portion of the loop portion, the table support supporting the center table above the support surface.

9. The picnic table as in claim 8, wherein the table support of the first leg include a pair of generally parallel support members and the table support of the second leg includes a pair of generally parallel support members.

10. The picnic table as in claim 9, further comprising a cross bar attached to the pair of generally parallel support members of the table support of the first leg and a cross bar attached to the pair of generally parallel support members of the table support of the second leg.

11. The picnic table as in claim 10, further comprising a pair of side rails connected to the center table, the side rails being connected to the a cross bar of the table support of the first leg and the cross bar of the table support of the second leg.

12. The picnic table as in claim 8, wherein the loop portion and the table support of the first leg are generally aligned in the same plane; and wherein the loop portion and the table support of the second leg are generally aligned in the same plane.

13. The picnic table as in claim 8, wherein the loop portion of the first leg is generally continuous; and wherein the loop portion of the second leg is generally continuous.

14. The picnic table as in claim 8, wherein the loop portion of the first leg includes an elongated upper member that is generally parallel to an elongated lower member; and wherein the loop portion of the second leg includes an elongated upper member that is generally parallel to an elongated lower member.

15. A picnic table comprising:

a first support including an at least substantially closed loop portion with a generally rectangular configuration and a table support portion, the loop portion being constructed from an integral, one-piece component, the table support portion being disposed proximate a center portion of the loop portion and being disposed between the first bench and the second bench, the table support portion being connected to a lower portion of the loop portion and an upper portion of the loop portion, the loop portion and the table support portion being generally aligned in the same plane;

a second support including an at least substantially closed loop portion and a table support portion, the loop portion being constructed from an integral, one-piece component, the table support portion being disposed proximate a center portion of the loop portion and being disposed between the first bench and the second bench, the table support portion being connected to a lower portion of the loop portion and an upper portion of the loop portion, the loop portion and the table support portion being generally aligned in the same plane;

a first bench connected to the loop portion of the first support and the loop portion of the second support;

a second bench connected to the loop portion of the first support and the loop portion of the second support; and a table portion connected to the table support portion of the first support and the table support portion of the second support.

16. The picnic table as in claim 15, wherein the loop portion of the first support and the loop portion of the second support are generally continuous.

17. The picnic table as in claim 15, wherein the loop portion of the first support is constructed from a single support tube and the loop portion of the second support is constructed from a single support tube.

18. The picnic table as in claim 15, wherein the table support portion of the first support includes a pair of generally upright supports that are connected to the loop portion of the first support, and the table support portion of the second support includes a pair of generally upright supports that are connected to the loop portion of the second support.

* * * * *

UNITED STATES PATENT AND TRADEMARK OFFICE

CERTIFICATE OF CORRECTION

PATENT NO. : 6,817,662 B2
DATED : November 16, 2004
INVENTOR(S) : Winter et al.

It is certified that error appears in the above-identified patent and that said Letters Patent is hereby corrected as shown below:

Title page,
Item [57], ABSTRACT,
Line 1, after "central table" insert -- that --

Column 4,
Line 12, after "members of the table" remove “,”
Line 58, after "are not intended to" change "limits" to -- limit --

Column 5,
Lines 22 and 31, after "interior chamber" remove “28”

Column 7,
Line 12, after "edge or boundary of" insert -- the --
Line 21, after "adhesives, and" insert -- the --

Column 8,
Line 52, before "like." insert -- the --

Column 10,
Line 3, after "benches" change "16 18." to -- 16, 18. --
Line 20, before "are preferably" change "80 82" to -- 80, 82 --
Line 47, after "first and second" change "support" to -- supports --

Column 12,
Line 31, after "the first leg" change "include" to -- includes --
Line 41, before "cross bar" remove “a”

Signed and Sealed this

Nineteenth Day of April, 2005

JON W. DUDAS
*Director of the United States Patent and Trademark Office*